US007761015B2

(12) United States Patent
Wong

(10) Patent No.: US 7,761,015 B2
(45) Date of Patent: Jul. 20, 2010

(54) TONER DISPENSING SYSTEM AND METHOD FOR CONTROLLING THE SAME

(75) Inventor: Kaiser Wong, Torrance, CA (US)

(73) Assignee: Samsung Electronics Co., Ltd., Suwon (KR)

( * ) Notice: Subject to any disclaimer, the term of this patent is extended or adjusted under 35 U.S.C. 154(b) by 447 days.

(21) Appl. No.: 11/935,624

(22) Filed: Nov. 6, 2007

(65) Prior Publication Data

US 2008/0131148 A1 Jun. 5, 2008

(30) Foreign Application Priority Data

Dec. 5, 2006 (KR) ..... 10-2006-0122539

(51) Int. Cl.
*G03G 15/08* (2006.01)

(52) U.S. Cl. ..... 399/27; 399/224; 399/258

(58) Field of Classification Search ..... 399/27, 399/29, 30, 81, 222, 224, 258
See application file for complete search history.

(56) References Cited

U.S. PATENT DOCUMENTS 5,349,377 A * 9/1994 Gilliland et al. ..... 347/131
6,374,064 B1 * 4/2002 Budnik et al. ..... 399/27
6,466,749 B1 * 10/2002 O'Brien ..... 399/27
6,810,218 B1 * 10/2004 Wong et al. ..... 399/27
2006/0222382 A1 * 10/2006 Gady et al. ..... 399/27

FOREIGN PATENT DOCUMENTS

JP 2005-060785 3/2005

* cited by examiner

*Primary Examiner*—David M Gray
*Assistant Examiner*—G. M. Hyder
(74) *Attorney, Agent, or Firm*—Staas & Halsey LLP

(57) ABSTRACT

A toner dispensing system and a method for controlling the same. A toner dispensing amount is determined using a pixel dispensing time related to a pixel count adjusted according to the ratio of a transition count to a pixel count per page, a Δ automatic concentration control dispensing time relating to the difference between the toner concentration of a developer material and target concentration, and a dispensing rate corresponding to a print job length. The determined amount of toner is dispensed into a developer housing. This method can maintain a toner concentration in order to obtain an accurate image density. A remaining toner ratio (%) determined from a total dispensing time, a dispensing rate, and a toner capacity can also be displayed so that the user can monitor the remaining amount of toner, the used amount of toner, etc., during the life of the toner cartridge.

21 Claims, 6 Drawing Sheets

FIG.4

| Ratio of Transition count to pixel count | a | b | c | d | e | f | g |
|---|---|---|---|---|---|---|---|
| Adjusted pixel dispense time | Aa | Ab | Ac | Ad | Ae | Af | Ag |

FIG.5

| | Current TC value | | |
|---|---|---|---|
| | < Target TC | = Target TC | > Target TC |
| Delta ATC dispense time | Positive value to be added to pixel dispense time | Zero value and no adjustment to pixel dispense time | Negative value to be added to pixel dispense time |

FIG.6

| | Average Job length | | |
|---|---|---|---|
| | Small | Medium | Large |
| Dispense Rate | S (Lowest) | M (medium) | L (Highest) |

TONER DISPENSING SYSTEM AND METHOD FOR CONTROLLING THE SAME

CROSS-REFERENCE TO RELATED APPLICATION

This application claims the benefit of Korean Application No. 2006-122539, filed Dec. 5, 2006, in the Korean Intellectual Property Office, the disclosure of which is incorporated herein by reference.

BACKGROUND OF THE INVENTION

1. Field of the Invention

Aspects of the present invention relate to a toner dispensing system, and a method for controlling the same.

2. Description of the Related Art

In a general electrophotographic printing process of an image forming apparatus, for example, a printer, a photocopier, a facsimile machine, or a multi-functional product, a photoreceptor (i.e. a photosensitive drum) is electrically charged, and is then exposed to a light pattern corresponding to an original image, whereby the surface of the photoreceptor is selectively discharged to form a latent image. After the latent image is recorded on the photoreceptor, developer material is applied to the photoreceptor to develop the latent image. Toner particles are attracted to the latent image to form a toner image on the photoreceptor. The toner image is then transferred from the photoreceptor to a printable medium, such as a sheet of paper. The toner particles are then fused into the sheet of paper, through a fusing unit, to fix a permanent image to the sheet of paper.

Process control software in image forming apparatuses, such as digital electrophotographic printers and copiers can count the actual number of pixels per page. Pixel counting has been used to estimate the amount of toner used in developing an image. The estimated value, representing the amount of toner consumed, is used to control a process of adding toner to a developer housing in a dual component development system, and to indicate the remaining amount of toner in a toner cartridge in a single component development system. In the dual component development system, for example, the toner concentration is maintained uniformly, while the image forming apparatus is in operation, to maintain print quality. To accomplish this, toner may be added to the developer housing, in a controllable fashion, during the entire printing process. In the single component development system, toner consumption is monitored, and a warning signal is given to the user when an "End of Life" condition is nearly reached.

However, when only the pixel count is used, it is not possible to describe different types of images, such as text/line, halftone, and solid area images, for which different amounts of toner are consumed. Due to the fringe field development effect, different types of images consume different amounts of toner for the same pixel count. Thus, the estimation method using only the pixel count is inaccurate.

U.S. Pat. No. 6,810,218 discloses an estimation method for different types of images using a pixel count and a pixel transition count. In this method, the ratio between the transition count (laser on/off or off/on) and the pixel count, are used to determine which type of image is most greatly exposed on the photoreceptor. Then, different amounts of toner used per pixel, depending on image types, are incorporated into the algorithm to provide a better estimation of toner usage.

The main feature of the U.S. Pat. No. 6,810,218 is to provide a method of more accurately estimating toner usage in the single component system using the pixel count and the transition count in the algorithm. This algorithm is used to generate a more accurate gas gauge that reflects a value close to an actual remaining toner ratio (%). When the printer has a hard stop (i.e., when the printer is stopped as the gas gauge indicates 0%), the actual remaining toner ratio approaches zero, if the gas gauge is accurate. However, U.S. Pat. No. 6,374,064 does not disclose an algorithm that uses transition and pixel counts, in the dispensing system, to replenish the toner consumed in the dual component development system.

U.S. Pat. No. 6,374,064 discloses a dispensing system that is controlled according to a combination of pixel dispensing, toner concentration (TC) dispensing, and patch dispensing, in an algorithm, to replenish toner consumed when developing a latent image. The dispensing system replenishes consumed toner, in a controllable fashion, in a dual component development system. However, the dispensing system uses only the pixel count no matter what type of image is dominant in the image. This dispensing system also uses only one dispensing rate regardless of the print job length, i.e., whether the print job length is long or short, or whether or not the print job is continuous. Without considering the job length, the dispensing system may fail to accurately determine the amount of toner to be dispensed to replenish consumed toner.

SUMMARY OF THE INVENTION

Therefore, it is an aspect of the invention to provide a toner dispensing system and a method for controlling the same, which provide toner concentration control to dispense an appropriate amount of toner, to maintain toner concentration of developer material at an appropriate level.

It is another aspect of the invention to provide a toner dispensing system and a method for controlling the same, which provide accurate toner consumption monitoring, to provide accurate information on the remaining and used amounts of toner, during an electrophotographic printing process.

Additional aspects and/or advantages of the invention will be set forth in part in the description which follows and, in part, will be obvious from the description, or may be learned by practice of the invention.

The foregoing and/or other aspects of the present invention may be achieved by providing a method for controlling a toner dispensing system, the method including: determining a first dispensing time corresponding to a pixel count, the first dispensing time having been adjusted according to a ratio of a transition count to a pixel count per page of a print image; determining a second dispensing time corresponding to a difference between a toner concentration of developer material, contained in a developer housing, and a target toner concentration; determining a dispensing rate based on print job length information; calculating a toner dispensing amount based on the dispensing rate and a total dispensing time equal to the sum of the first and second dispensing times; and adding toner to the developer housing based on the calculated toner dispensing amount.

The foregoing and/or other aspects of the present invention may also be achieved by providing a toner dispensing system including: an image forming apparatus having a developer housing and a toner cartridge; a rotatable auger, provided in the toner cartridge, to dispense toner; a dispensing motor to rotate the auger to dispense toner to the developer housing; a toner concentration sensor to measure a toner concentration of developer material in the developer housing; a logic circuit to measure a pixel count and a transition count per page of a print image; and a printer controller to determine a toner dispensing amount based on a first dispensing time corresponding to a pixel count. The first dispensing time is adjusted according to a ratio of the transition count to the pixel count, as measured by the logic circuit, a second dispensing time corresponding to a difference between the toner concentration, measured by the toner concentration sensor, and a target toner concentration, and a dispensing rate, corresponding to print job length information, to control operation of the dispensing motor to add toner to the developer housing.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which:

FIG. 4 is a table illustrating how an adjusted pixel dispensing time is calculated from the ratio of a transition count to a pixel count shown in FIG. 3;

FIG. 5 is a table illustrating how a delta automatic toner control (ATC) dispensing time is calculated from a toner concentration (TC) shown in FIG. 3; and FIG. 6 is a table illustrating the relationship between the dispensing rate and the print job length shown in FIG. 3.

DETAILED DESCRIPTION OF THE EMBODIMENTS

Figure 1:
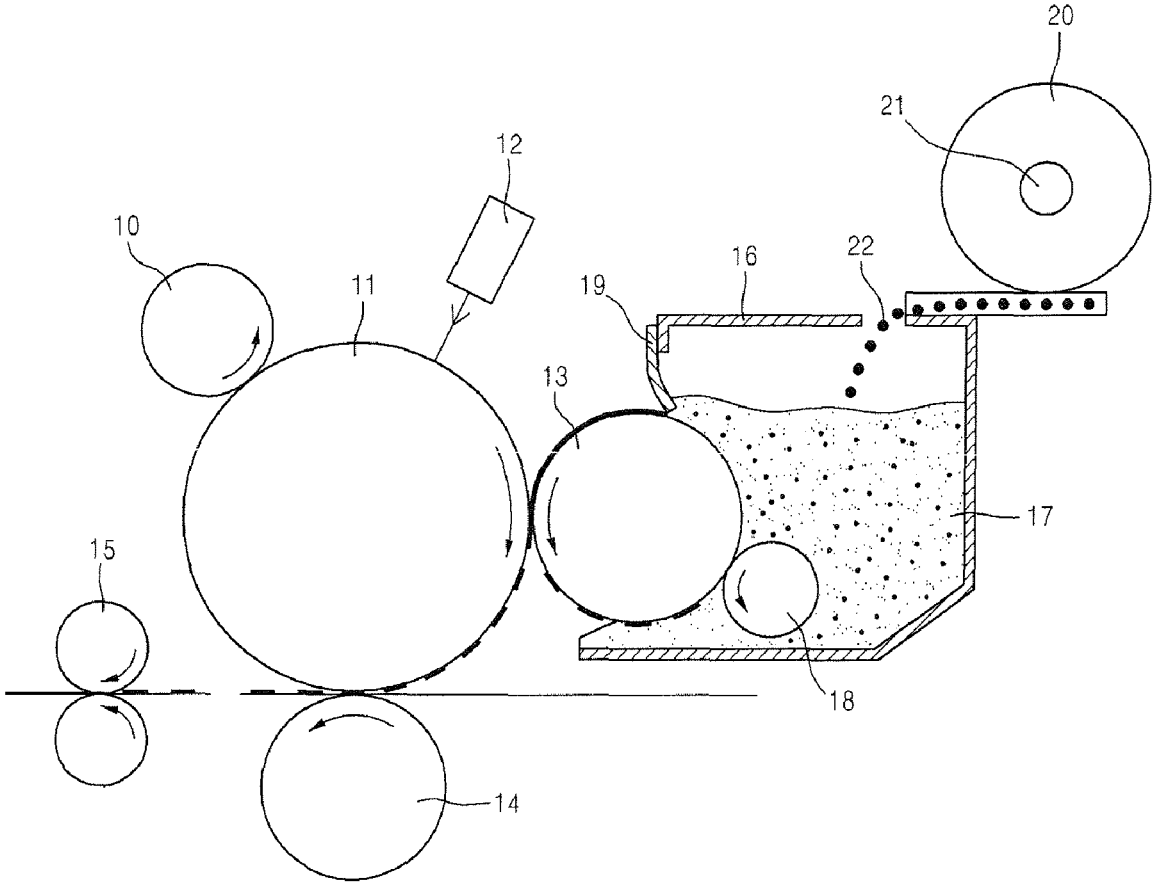
FIG. 1 illustrates basic elements of an image forming apparatus.

Reference will now be made in detail to various embodiments of the present invention, examples of which are illustrated in the accompanying drawings, wherein like reference numerals refer to the like elements throughout. The embodiments are described below in order to explain the present invention by referring to the figures.

FIG. 1 illustrates basic elements of an image forming apparatus, according to an example embodiment of the present teachings. In an electrophotographic printing process, first, a charge roller 10 charges a photoreceptor 11. A corotron/scorotron may be used instead of the charge roller 10.

A laser scanner unit 12 selectively discharges the photoreceptor 10 in a pattern corresponding to an image to be printed. A raster outer scanner (ROS) may be used instead of the laser scanner unit 12.

The laser scanner unit 12 generally includes a laser source and a revolutionary polygon mirror (not shown) and discharges specific portions of the charged photoreceptor 11. The laser source is modulated (turned on and off) according to received digital image data, and a rotating polygon mirror causes a modulated laser beam from the laser source to move in fast scanning direction.

After the laser scanner unit 12 discharges the specific portions of the photoreceptor 11, a developer roller 13 develops the discharged portions of the photoreceptor 11 in a discharged area develop (DAD) system. Toner particles in developer material 17 are attracted to the discharged portions of the photoreceptor 11. A supply roller 18 supplies the developer material 17, from a developer housing 16, to the developer roller 13. A regulator blade 19 contacts a developer roller 13 to uniformly form a developer layer on the surface of the developer roller 13, by regulating the developer material 17 that is supplied to the surface of the developer roller 13. A toner cartridge 20 is provided above the developer housing 16, to add toner to the developer housing 16. As a conveyor, a rotatable auger 21 is provided, in the toner cartridge 20 at a center portion thereof. As the auger 21 rotates, toner particles 22, in the toner cartridge 20, are added to the developer housing 16. The developer material 17 that is attached to the photoreceptor 11 is then conveyed to a transfer roller 14 to cause the attached developer material 17 to be electrically transferred to a printable medium, such as a sheet of paper, to form a toner image on the sheet of paper. A transfer corotron may be used instead of the transfer roller 14. The sheet of paper on which the toner image is formed then passes through a fuser roller 15, which fuses the toner image onto the sheet of paper, to form a permanent image.

Figure 2:
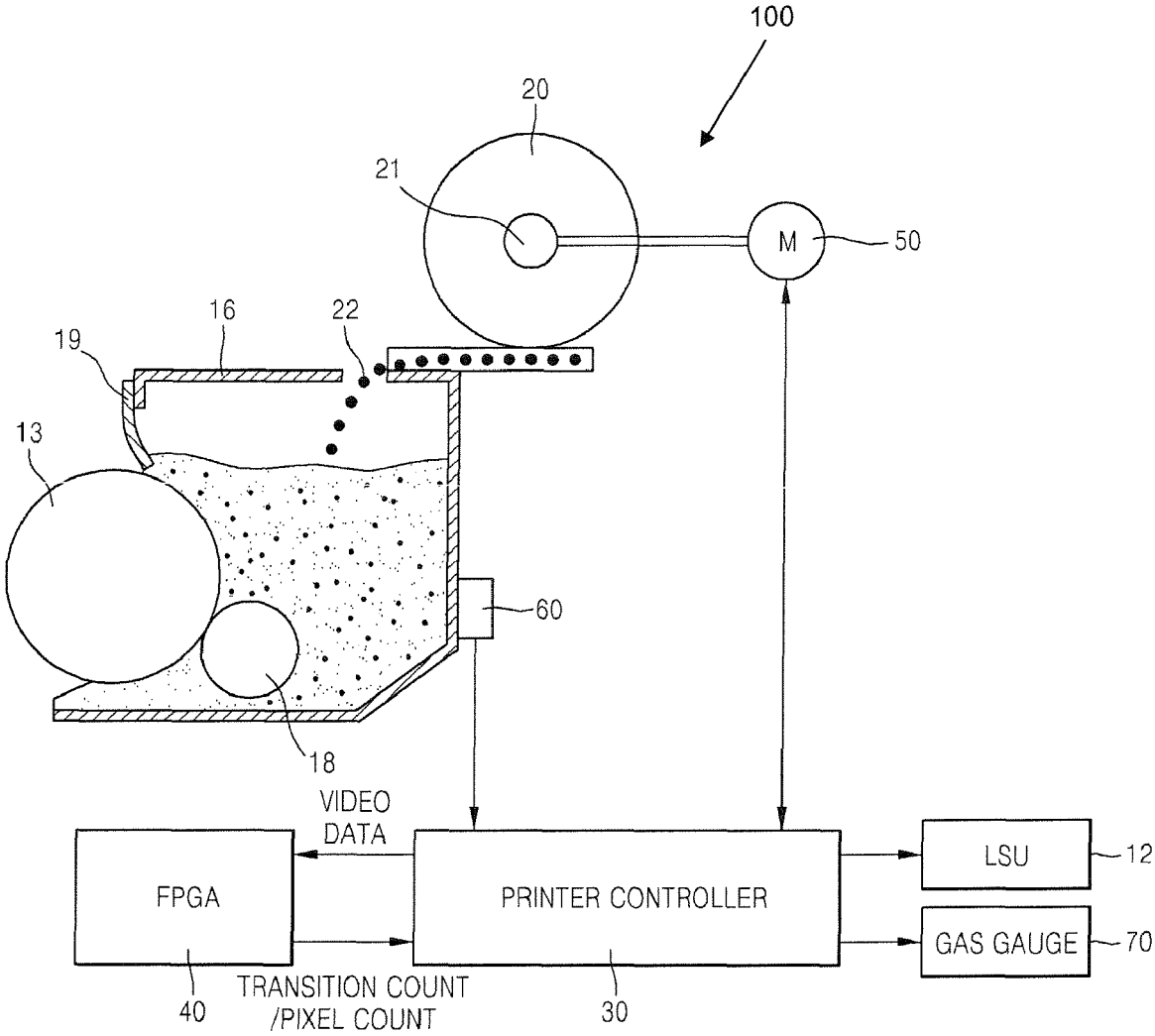
FIG. 2 illustrates a schematic configuration of a toner dispensing system, according to an example embodiment of the present invention.
Figure 3:
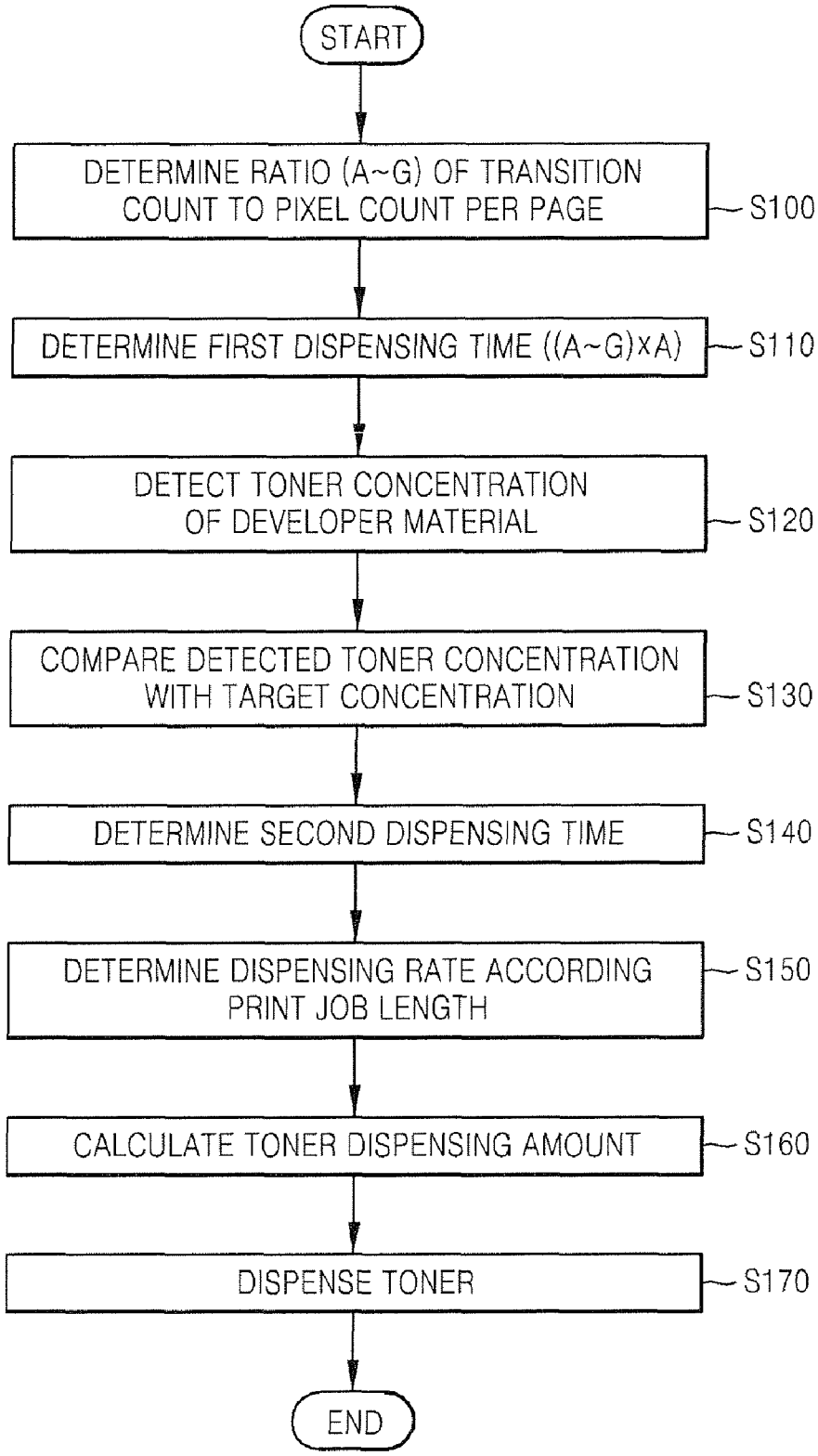
FIG. 3 is a control flow diagram illustrating operations of the toner dispensing system, according to an example embodiment of the present invention.

FIG. 2 illustrates a schematic configuration of a toner dispensing system 100, according to an example embodiment of the present invention. FIG. 3 is a control flow diagram illustrating operations of the toner dispensing system, according to the example embodiment of the present invention. The toner dispensing system 100 includes, a developer unit, a toner cartridge 20, a printer controller 30, a field programmable gate array (FPGA) 40, a dispensing motor 50, a toner concentration (TC) sensor 60, and a gas gage 70. In other embodiments, the printer controller 30 cane comprise the FPGA 40 and/or the TC sensor 60. Attentively, the printer controller 30 can comprise a microprocessor, a computer, or any suitable calculating device.

As shown in FIGS. 2 and 3, the printer controller 30 generates an electronic pixel stream (video data) corresponding to an image to be printed on a printable medium. The printer controller 30 then transmits the video data to a laser scanner unit 12. The printer controller 30 also transmits the video data to a logic circuit, such as the FPGA 40. The FPGA 40 counts pixels (pixel count) and transitions (transition count) per page. The video data is transmitted to a pixel counter in the FPGA 40. The pixel counter keeps track of "ON" pixels on the page. Another counter in the FPGA is a transition counter register that counts transitions from "1" to "0" (from ON to OFF) or from "0" to "1" (from OFF to ON) in a horizontal scanning direction. The printer controller 30 receives a pixel count and a transition count per page from the FPGA 40.

According to various embodiments and as illustrated in FIG. 3, the present teachings encompass a method of controlling a toner dispensing system. The method can comprise using an algorithm to determine an amount of toner to be added to a developer material. In operation S100, the printer controller 30 calculates the ratio between the transition and pixel counts per page (specifically, the ratio of the transition count to the pixel count). The respective ratios between the transition and the pixel counts of three types of images (i.e., solid, text/line, and halftone images) are different from each other.

The transition to pixel count ratio of the solid images is lowest since only two transitions (a transition from off to on and a transition from on to off) are present at both edges in a fast scanning direction of a solid image, while the pixels are always on in bulk images. The transition to pixel count ratio of the halftone images is highest since a large number of transitions are present in a halftone image. The transition to pixel count ratio of the text/line images is higher than that of solid images and lower than that of halftone images. The different transition to pixel count ratios (for example, in a percentage) of different types of images, such as solid, line, and halftone images are carefully determined from experiments. For example, the transition to pixel count ratios of 100% (pure) solid images, 100% text/line images, and 100% halftone images may be determined, and the determined ratios may then be set as set points. The transition to pixel count ratios may also be determined for solid images, text/line images, and images of different percentages.

In operation S110, the printer controller 30 determines a first dispensing time by adjusting a pixel dispensing time corresponding to the pixel count using the transition to pixel count ratio that is determined in operation S100, as shown in FIG. 4. More specifically, the first dispensing time is the product of the transition to pixel count ratio (a-g) and a pixel dispensing time A, corresponding to the pixel count. The pixel dispensing time A, corresponding to the pixel count, is obtained from an auger rotation count corresponding to the pixel count. For the same pixel count, different types of images consume different amounts of toner, and thus, different dispensing times must be applied to different types of images. More specifically, for a specific pixel count, the dispensing time for the halftone images is the longest, the dispensing time for the solid images is the shortest, and the dispensing time for the text/line images is between the dispensing times for halftone and solid images, due to the "fringe field" development effect. From the transition to pixel count ratios per page, it is possible to approximately determine which type of image is most dominant on the page among the different types of images, and a corresponding dispensing time is applied to the most dominant type of image.

The first dispensing time is a primary one in the dispensing system. Another element to be considered in the toner dispensing algorithm is a second dispensing time, due to the difference between the current and the target toner concentrations. This toner concentration difference is detected by a toner concentration (TC) sensor 60 that sequentially provides delta automatic toner control values. The TC sensor 60 is an electromagnetic sensor which measures the permeability of the developer material. Each delta automatic toner control value is converted into a corresponding delta automatic toner dispensing time. The delta automatic toner dispensing time is obtained from an auger rotation count corresponding to the delta automatic toner control value.

In operations S120 and S130, the print controller 30 detects a toner concentration of the developer material using the TC sensor 60 and compares the detected toner concentration with the target toner concentration. If the comparison of operation S130, that the detected toner concentration is equal to the target concentration, the printer controller 30 determines the delta automatic toner control dispensing time (i.e., the second dispensing time) to be equal to a reference time. If the detected toner concentration is lower than the target concentration, the printer controller 30 determines the second dispensing time to be greater than the reference time. On the other hand, if the detected toner concentration is higher than the target concentration, the printer controller 30 determines the second dispensing time to be less than the reference time. More specifically, as shown in FIG. 5, if the toner concentration after the primary pixel dispensing is lower than the target concentration, the delta automatic toner control value is positive, and a corresponding dispensing time is added to the first dispensing time, so as to dispense more toner particles 22 into the developer housing 16. If the toner concentration is higher than the target concentration, the delta automatic toner control value is negative to reduce the first dispensing time by a corresponding dispensing time.

A third input element to be considered in the toner dispensing algorithm is the dispensing rate. When a dispensing motor 50, to rotate the auger 21, receives an ON signal the dispensing motor 50 begins rotating according to information of the final dispensing time that is equal to the first dispensing time+the second dispensing time. However, when the dispensing motor 50 receives an OFF signal, the dispensing motor 50 is immediately deactivated but continues rotating for a time due to inertia. Due to this overrun phenomenon, additional toner particles 22 are added to the developer housing 16. If a print job is stopped every few pages, the overrun phenomenon more frequently occurs, and more toner particles 22 than are added to the developer housing 16. The overrun phenomenon rarely occurs when the image forming apparatus is in a large print job mode that requires continuous printing of a large number of pages. For the sake of simplicity, the dispensing rate can be classified into three types. For example, in the case of an intermediate-level printer, with a print speed up to 50 pages per minute (ppm), different dispensing rates may be allocated to: print jobs with a long job length in which more than 50 pages are continuously printed; print jobs with an intermediate job length in which about 6 pages are continuously printed; and print jobs with a short job length in which about 2 pages are continuously printed. It is very important that the dispensing rate of each of the types of printers be determined for an estimated average length of the print jobs that most users will carry out with the printer.

In operation S150, the printer controller 30 determines a dispensing rate according to print job length information. This dispensing rate is allocated to the final dispensing time and serves as a factor to increase or decrease the final dispensing time. When a large-scale continuous print jobs are performed the overrun phenomenon of the dispensing motor 50, due to stop and restart of the dispensing motor 50, rarely occurs, thus no or comparatively few additional toner particles 22 are dispensed to the developer housing 16, so a higher dispensing rate should be used. When print jobs that are on average shorter in length are performed, for example when one or two pages are printed per job, the dispensing motor 50 is frequently stopped and restarted, thus additional toner particles 22 are dispensed, due to the overrun phenomenon of the dispensing motor 50. When shorter print jobs are generally performed a lower dispensing rate should be used. More specifically, as shown in FIG. 6, the dispensing rate is determined to be higher when, on average, longer print jobs are performed, in that a larger number of pages on average are continuously printed. The dispensing rate is determined to be lower when, on average, shorter print jobs are performed, in that a smaller number of pages are continuously printed.

The operation S150 can comprise determining an average print job length. This average print job length can be used to calculate the toner dispensing amount. For example, if the average print job length increases (relative to a just previous average print job length), the dispensing rate can be increased. If the average print job length decreases (relative to a just previous average print job length), the dispensing rate can be decreased. In this way, the overrun phenomenon can be compensated for.

In operation S160, the printer controller 30 calculates a toner dispensing amount, i.e. the amount of toner to be dispensed, based on the dispensing rate and the total dispensing time that is the sum of the first and second dispensing times. Here, the toner dispensing amount corresponds to the total dispensing time that has been increased or decreased by multiplying the total dispensing time by the dispensing rate. In operation S170, the printer controller 30 dispenses the amount of toner 22 calculated in operation S160 to the developer housing 16. This allows the toner concentration to be uniformly maintained while the printer is running. When a gas gauge 70 is provided as a display unit to allow the user to monitor remaining and consumed amounts of toner, the printer controller 30 determines and displays a remaining toner ratio (%), during the effective period of the toner cartridge 20, on the gas gauge 70. The remaining toner ratio (%) can be expressed by the following equation:

$$\text{Remaining Toner Ratio}(\%)=100-(\text{Dispensing Rate}\times\text{Total Dispensing Time/Toner Capacity}).$$

The total dispensing time can be expressed by an auger rotation count. The total dispensing time is the sum of the delta automatic control dispensing time and the pixel dispensing time corresponding to the pixel count, with the pixel dispensing time having been adjusted according to the transition to pixel count ratio. The dispensing rate is determined according to an average print job length.

As is apparent from the above description, aspects of the present invention provide a toner dispensing system and a method for controlling the same, which have the following advantages. A toner dispensing amount is determined using a pixel dispensing time corresponding to a pixel count, adjusted according to the ratio of a transition count to a pixel count per page, a delta automatic concentration control dispensing time corresponding to the difference between a toner concentration of developer material contained in a developer housing and a target concentration, and a dispensing rate corresponding to a print job length. Thus the determined amount of toner is dispensed to the developer housing. This it is possible to maintain a toner concentration suitable for an accurate image density. In addition, a remaining toner ratio (%), determined from a total dispensing time, a dispensing rate, and a toner capacity, are displayed so that the user can monitor the remaining amount of toner, the used amount of toner, and the like, during the effective life of the toner cartridge.

While there have been illustrated and described what are considered to be example embodiments of the present invention, it will be understood by those skilled in the art and as technology develops that various changes and modifications, may be made, and equivalents may be substituted for elements thereof, without departing from the true scope of the present invention. Many modifications, permutations, additions, and sub-combinations may be made to adapt the teachings of the present invention to a particular situation without departing from the scope thereof. Alternative embodiments of the taught method and/or algorithm can be implemented as a computer program product for use with a computer system. Such a computer program product can be, for example, a series of computer instructions stored on a tangible data recording medium, such as a diskette, CD-ROM, ROM, or fixed disk, or embodied in a computer data signal, the signal being transmitted over a tangible medium or a wireless medium, for example microwave or infrared. The series of computer instructions can constitute all or part of the functionality described above, and can also be stored in any memory device, volatile or non-volatile, such as semiconductor, magnetic, optical or other memory device. Furthermore, the software modules as described can also be machine-readable storage media, such as dynamic or static random access memories (DRAMs or SRAMs), erasable and only memories (EEPROMs) and flash memories; magnetic disks such as fixed, floppy and removable disks; other magnetic media including tape; and optical media such as compact discs (CDs) or digital video discs (DVDs). Accordingly, it is intended, therefore, that the aspects of present invention not be limited to the various example embodiments disclosed, but that the present invention includes all embodiments falling within the scope of the appended claims.

What is claimed is:

1. A method for controlling a toner dispensing system, the method comprising:

determining a first dispensing time based on a transition to pixel count ratio and a pixel dispensing time;

determining a second dispensing time based on a toner concentration of a developer material and a target toner concentration;

determining a dispensing rate based on print job length information;

calculating a toner dispensing amount based on the dispensing rate and a total dispensing time that is equal to the sum of the first dispensing time and the second dispensing time; and adding toner to the developer material based on the calculated toner dispensing amount.

2. The method according to claim 1, wherein the determining of the first dispensing time comprises multiplying a dispensing time by the transition to pixel count ratio.

3. The method according to claim 1, wherein the determining of the transition to pixel count ratio comprises using a field programmable gate array (FPGA) to count transitions and pixels of the print job.

4. The method according to claim 1, wherein the transition to pixel count ratio differs when the print job consists of one of solid images, text/line images, and halftone images.

5. The method according to claim 1, wherein the determining of the second dispensing time comprises:

measuring the toner concentration of the developer material;

comparing the toner concentration with the target toner concentration;

determining the second distribution time to be equal to a reference time if the toner concentration is equal to the target toner concentration;

determining the second distribution time to be greater than the reference time if the toner concentration is lower than the target toner concentration; and determining the second distribution time to be less than the reference time if the toner concentration is higher than the target toner concentration.

6. The method according to claim 1, wherein the determining of the dispensing rate comprises compensating for a toner overrun based on an average print job length.

7. The method according to claim 1, further comprising:

determining a remaining toner ratio by using the total dispensing time, the dispensing rate, and a toner capacity in the following equation:

$$\text{Remaining Toner Ratio}(\%)=100-(\text{Dispensing Rate}\times\text{Total Dispensing Time/Toner Capacity}).$$

8. The method according to claim 7, further comprising displaying the determined remaining toner ratio.

9. The method according to claim 8, wherein the displaying of the determined remaining toner ratio is to allow a user to monitor a remaining amount of toner in a toner cartridge.

10. The method according to claim 1, wherein the determining of the second dispensing time comprises calculating a difference between the current toner concentration and the target toner concentration.

11. The method according to claim 1, wherein the first dispensing time is determined per page of the print job.

12. The method according to claim 1, wherein the second distribution time is determined to be:

zero if the toner concentration is equal to the target toner concentration;

a positive value, if the toner concentration is lower than the target toner concentration; and a negative value, if the reference time if the toner concentration is higher than the target toner concentration.

13. The method according to claim 1, wherein the determining of the dispensing rate comprises:

calculating the average print job length; and increasing or decreasing the dispensing rate if the average print job length increases or decreases, respectively, relative to a previous dispensing rate.

14. The method according to claim 1, wherein the adding of the toner further comprises:

adding a reference amount of toner to the developer material if the toner concentration is equal to the target toner concentration, wherein the reference amount is equal to the dispensing rate multiplied by the first dispensing time;

adding more toner relative to the reference amount to the developer material, if the toner concentration is lower than the target toner concentration; and adding less toner relative to the reference amount to the developer material, if the toner concentration is greater than the target toner concentration.

15. The method according to claim 1, wherein the pixel dispensing time is obtained from an auger rotation count corresponding to a pixel count.

16. A toner dispensing system including an image forming apparatus having a developer housing and a toner cartridge, the system comprising:

a toner concentration sensor to measure the concentration of toner in a developer material disposed in the developer housing; and a printer controller to determine a toner dispensing amount based on, a first dispensing time calculated from a transition to pixel count ratio and a pixel dispensing time, of a print job, a second dispensing time calculated from a measured toner concentration and a target toner concentration, and a dispensing rate calculated from the length of the print job.

17. The toner dispensing system according to claim 16, wherein the printer controller comprises a field programmable gate array (FPGA) to determine a pixel count and a transition count per page of the print job.

18. The toner dispensing system according to claim 16, wherein the printer controller calculates the first dispensing time by multiplying the pixel dispensing time by the transition to pixel count ratio.

19. The toner dispensing system according to claim 16, wherein the printer controller:

compares the measured toner concentration with the target toner concentration;

determines the second distribution time to be equal to a reference time if the toner concentration is equal to the target toner concentration;

determines the second distribution time to be greater than the reference time if the toner concentration is lower than the target toner concentration; and determines the second distribution time to be less than the reference time if the toner concentration is higher than the target toner concentration.

20. The toner dispensing system according to claim 16, wherein the printer controller determines the dispensing rate to be lower when a long print job is performed and determines the dispensing rate to be higher when a short print job is performed.

21. The toner dispensing system according to claim 16, further comprising:

a gas gauge to display a remaining toner ratio of the toner cartridge.

* * * * *